US006304842B1

(12) United States Patent
Husain et al.

(10) Patent No.: US 6,304,842 B1
(45) Date of Patent: Oct. 16, 2001

(54) LOCATION AND CODING OF UNVOICED PLOSIVES IN LINEAR PREDICTIVE CODING OF SPEECH

(75) Inventors: Mohammad Aamir Husain, Surrey; Bhaskar Bhattacharya, Port Coquitlam, both of (CA)

(73) Assignee: Glenayre Electronics, Inc., Charlotte, NC (US)

( * ) Notice: Subject to any disclaimer, the term of this patent is extended or adjusted under 35 U.S.C. 154(b) by 0 days.

(21) Appl. No.: 09/345,705

(22) Filed: Jun. 30, 1999

(51) Int. Cl.[7] ..... G10L 11/06
(52) U.S. Cl. ..... 704/214; 704/230; 704/219
(58) Field of Search ..... 704/230, 223, 704/219, 220, 214, 262, 263, 264

(56) References Cited

U.S. PATENT DOCUMENTS

| | | | | |
|---|---|---|---|---|
| Re. 32,580 | * | 1/1988 | Atal et al. | 704/219 |
| 5,091,946 | * | 2/1992 | Ozawa | 704/208 |
| 5,794,186 | * | 8/1998 | Bergstrom et al. | 704/223 |
| 5,839,102 | * | 11/1998 | Haagen et al. | 704/230 |

FOREIGN PATENT DOCUMENTS

| | | |
|---|---|---|
| 173986A | 3/1986 | (EP) . |
| 852376A | 7/1998 | (EP) . |

OTHER PUBLICATIONS

Susumu Sato et al: "Recognition of Plosive Using Mixed Features by Fisher's Linear Discriminant" Proceedings of the International Conference on Spoken Language Processing (ICSLP), JP, Tokyo, ASJ, 1990 pp. 213–216.

Weigelt L F et al: "Plosive/Fricative Distinction: The Voiceless Case" Journal of the Acoustical Society of America, US, American Institute of Physics. New York, vol. 87, No. 6, Jun. 1, 1990, pp. 2729–2737.

"An Improved Mixed Excitation Linear Prediction (MELP) Coder", Unno et al, Proc. IEEE Intl. Conf. on Audio, Speech & Signal Processing, 1999, vol. 1., pp. 245–248.

* cited by examiner

*Primary Examiner*—Richemond Dorvil
*Assistant Examiner*—Daniel Abebe
(74) *Attorney, Agent, or Firm*—Oyen Wiggs Green & Mutala

(57) ABSTRACT

A method of encoding signal segments which represent unvoiced plosives. The signal segments to be encoded are contained within a speech signal divided into m=1, . . . , N frames. Each frame is subdivided into l=1, . . . , L subframes. The speech signal has a gain $g^m(l)$ within each subframe. An energy measure $e^m(l)$ representative of the signal segments' energy content is defined. An energy threshold $e_{th}(l)$ representative of a sudden energy change characteristic of an unvoiced plosive is also defined. For each frame, the energy measure $e^m(l)$ and the energy threshold $e_{th}(l)$ are derived for each subframe within that frame. If $e^m(l) \leqq e_{th}(l)$ for each subframe within a particular frame, then a plosive locator $l_{pl}=0$ and a plosive index $i_{pl}=0$ are assigned to that frame to indicate absence of a plosive within that frame. If $e^m(l)>e_{th}(l)$ for any subframe within the frame, then that frame's plosive locator $l_{pl}$ is assigned a non-zero value, with the plosive locator's value indicating location of the plosive at a transition point immediately following that one of the subframes within the frame for which $e^m(l)-e_{th}(l)$ is greatest; and, that frame's plosive index $i_{pl}$ is assigned a non-zero value representing presence of a plosive within that frame.

11 Claims, 4 Drawing Sheets

LOCATION AND CODING OF UNVOICED PLOSIVES IN LINEAR PREDICTIVE CODING OF SPEECH

TECHNICAL FIELD

This invention is directed to linear predictive coding of speech sounds in a manner which more accurately represents the sudden energy variations which characterize unvoiced plosives.

BACKGROUND

Linear Predictive Coding (LPC) of speech involves estimating the coefficients of a time varying filter (henceforth called a "synthesis filter") and providing appropriate excitation (input) to that time varying filter. The process is conventionally broken down into two steps known as encoding and decoding.

As shown in FIG. 1, in the encoding step, the original speech signal s is first filtered by pre-filter 10. The pre-filtered speech signal $s_p$ is then analyzed by LPC Analysis block 14 to compute the coefficients of the synthesis filter. Then, an LPC analysis filter 12 is formed, using the same coefficients as the synthesis filter but having an inverse structure. The pre-filtered speech signal $s_p$ is processed by analysis filter 12 to produce a residual output signal u called the "residue". Information about the filter coefficients and the residue is passed to a decoder (not shown) for use in the decoding step.

In the decoding step, a synthesis filter is formed using the coefficients obtained from the encoder. An appropriate excitation signal is applied to the synthesis filter, based on the information about the residue obtained from the encoder. The synthesis filter outputs a synthetic speech signal, which is ideally the closest possible approximation imitation to the original speech signal, s.

This invention pertains to the processing of unvoiced plosives in the residue (i.e. the process steps shown in blocks 20–28 enclosed within the dashed outline portions of FIG. 1). During unvoiced speech, plosives (or stops) in the residue are characterized by sudden variations in energy from one block of speech samples to the next. Prior art linear predictive speech coding techniques have achieved only poor representation of unvoiced plosives. In particular, prior art techniques typically represent unvoiced plosives by interpolating energy variations between relatively few samples spaced relatively far apart. This yields a gradual variation in energy, which does not accurately reflect unvoiced plosives' sudden energy variations. This invention achieves more accurate location and coding of unvoiced plosives in the residue. Information about the location of the start of the sudden energy variation (burst portion of the unvoiced plosive) in the residue is encoded. This enables the decoder to produce a synthetic excitation signal having sudden energy variations during unvoiced plosives, thereby improving the quality of the synthetic speech considerably.

SUMMARY OF INVENTION

The invention provides a method of encoding signal segments which represent unvoiced plosives. The signal segments to be encoded are contained within a speech signal divided into m=1, . . . , N frames. Each frame is subdivided into l=1, . . . , L subframes. The speech signal has a gain $g^m(l)$ within each subframe.

In accordance with the invention, an energy measure $e^m(l)$ representative of the signal segments' energy content is defined. An energy threshold $e_{th}(l)$ representative of a sudden energy change characteristic of an unvoiced plosive is also defined. For each frame, the energy measure $e^m(l)$ and the energy threshold $e_{th}(l)$ are derived for each subframe within that frame. If $e^m(l) \leqq e_{th}(l)$ for each subframe within a particular frame, then a plosive locator $l_{pl}=0$ and a plosive index $i_{pl}=0$ are assigned to that frame to indicate absence of a plosive within that frame. If $e^m(l)>e_{th}(l)$ for any subframe within the frame, then that frame's plosive locator $l_{pl}$ is assigned a non-zero value indicating location of the plosive at a transition point immediately following that one of the subframes within the frame for which $e^m(l)-e_{th}(l)$ is greatest; and, that frame's plosive index $i_{pl}$ is assigned a non-zero value representing presence of a plosive within that frame.

The plosive index $i_{pl} \neq 0$ is assigned as:

$$\text{if } (l_{pl}<L)$$

$$i_{pl}=J(l_{pl}-1)+k \quad k=j \text{ if } g^m(l_{pl}) \epsilon (g_{level}(j-1), g_{level}(j)],\ j=1, \ldots, J$$

else $$i_{pl}=2^K-1$$

end if where, $l_{pl}$ is the subframe for which the energy measure exceeds the energy measure threshold, J is the predefined value of the number of levels used in quantizing the gain, $g^m(l_{pl})$, $K=\lceil \log_2(J(L-1)+2) \rceil$ is the value of the number of bits used in encoding the plosive locator $l_{pl}$ and $g_{level}$ is the predefined quantized gain decision level vector.

The invention further provides a method of decoding a signal which has been encoded as above. Since the encoder's gain values are not directly available to the decoder, the encoder provides a quantized gain vector for use by the decoder. In order to minimize the encoded bit rate, the gain of only one subframe is quantized, with the remaining elements of the quantized gain vector being estimated in a manner which ensures reproduction of the sudden energy variations necessary for improved characterization of plosives.

DESCRIPTION

1. Introduction

Figure 1:
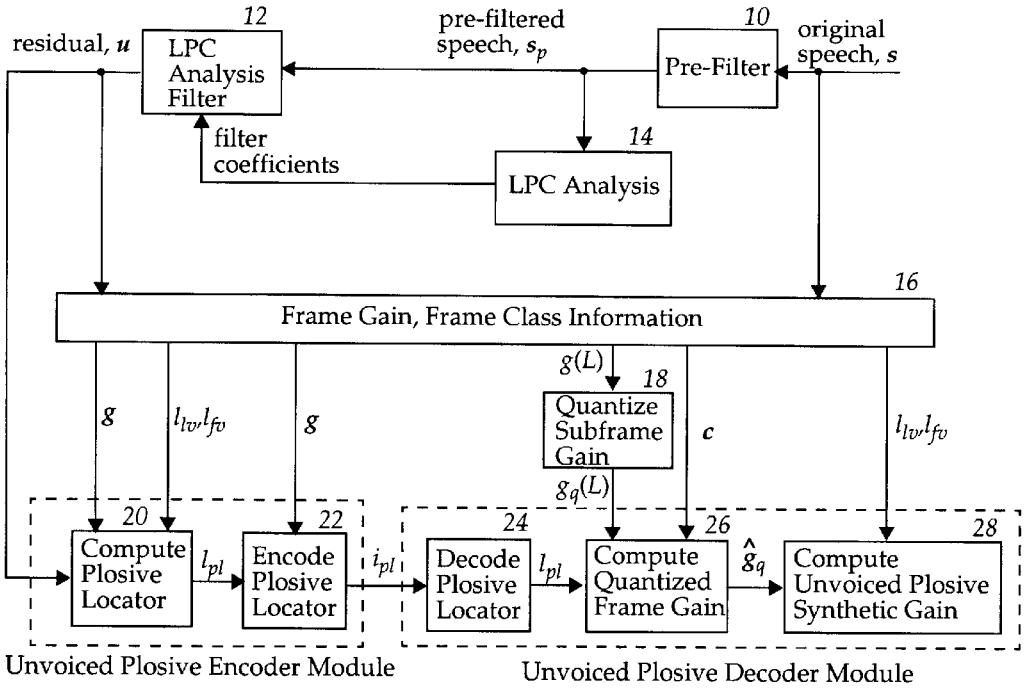
FIG. 1 is a block diagram representation of an LPC based speech encoding method in which unvoiced plosives are located and coded in accordance with the invention.

The original speech signal, s, is processed one frame at a time. Each "frame" contains N samples of the original speech signal, divided into L subframes. Typical values for these parameters are N=320 and L=4. The pre-filtered signal, $s_p$, is obtained by passing the original speech signal, s, through a pre-processing filter 10.

The residual signal, or "residue", u, is obtained by passing the pre-filtered signal, $s_p$, through a time-varying all-zero LPC analysis filter 12. The coefficients of analysis filter 12 are derived by LPC analysis block 14 using techniques which are well known in the art and which need not be described further.

The energy variation in each frame, m, is represented by a gain vector, $g^m=\{g^m(l): l=1, \ldots, L\}$, which corresponds to the root mean square values of the residual signal (in dBs) over a window (length typically 80–160 samples) centered at sampling instants corresponding to the last sample in each subframe of the frame.

A frame class information vector, c, consisting of voicing information for the L subframes in the frame, is provided (FIG. 1, block 16) in accordance with techniques known to persons skilled in the art. In particular, each subframe, l=1, . . . , L, is classified as either unvoiced (c(l)=0) or voiced (c(l)=1). $l_{fv}$ is defined as the position number of the first voiced subframe in the $m^{th}$ frame. $l_{lv}$ is defined as the position of the last voiced subframe in the $m^{th}$ frame.

2. Encoding of Plosive Indices

During plosives (or stops) the residue exhibits sudden variations in energy from one block of samples to the next. A plosive index, $i_{pl}$, is defined (FIG. 1, block 22) to indicate whether a frame contains an unvoiced plosive or not, and if so, the location of the start of the sudden energy variation (burst portion of the plosive) in the residue. The plosive locator, $l_{pl}$, is defined (FIG. 1, block 20) as the subframe, within the $m^{th}$ frame, at the end of which the start of the burst portion of the plosive is found. The start of the burst portion of the plosive thus coincides with the boundary of the subframe $l_{pl}$, and the subsequent subframe. For example, if $l_{pl}=1$, then the plosive's sudden energy variation starts at the transition boundary between the first and second subframes, and the energy of the samples in the second subframe must be made significantly larger than the energy of the samples in the first subframe to attain more accurate representation of unvoiced plosives in the decoder. The burst portion of the plosive is located by searching across all contiguous unvoiced subframes. The first contiguous unvoiced subframe is denoted by $l_{start}$. The last contiguous unvoiced subframe is denoted by $l_{stop}$. For simplicity, it is assumed that there is at most one plosive within a particular frame.

The energy variation in each frame, m, is also represented by an "energy measure" vector, $e^m=\{e^m(l): l=1, \ldots, L\}$, which corresponds to a function of the energy of the residual signal over a window centered at sampling instants corresponding to an appropriate sample in each subframe of the frame. In the preferred embodiment of the invention, $e^m$ is equivalent to the gain vector, $g^m=\{g^m(l): l=1, \ldots, L\}$. However, many alternative energy measures can be used, one possible example being the "peakiness value" defined by Unno et al: *An Improved Mixed Excitation Linear Prediction (MELP) Coder*, Proc. IEEE Intl. Conf. On Acoustic, Speech & Signal Processing, 1999, Vol. 1, pp. 245–248.

The plosive locator, $l_{pl}$, in the $m^{th}$ frame, is obtained as follows (typically, $e_{thresh}=10$, $a_e=1$ and $b_e=1$):

define $e^m(\mathbf{0})=e^{m-1}(L)$ $l_{pl}=0$ $e_d^P=0$ $l_{start}$=location of first unvoiced subframe $l_{stop}$=location of last unvoiced subframe for $l=l_{start}$ to $l_{stop}$ $p2$ $e_{th}(l)=a_e e^m(l-1)+b_e e_{thresh}$ $e_d=e^m(l)-e_{th}(l)$ if($e_d>e_d^P$)

$l_{pl}=l$ $e_d^P=e_d$ end if end for where, $e_{thresh}$ is a energy threshold constant value (for example, $e_{thresh}=10$ dB); and, $a_e$ and $b_e$ are energy measure threshold weight constants. It can thus be seen that plosive detection can be adaptively adjusted to directly compare each subframe's energy measure to a energy threshold constant value, and/or to take the previous subframe's energy measure into account. For example, if $a_e=0$ and $b_e=1$, then the energy measure of the previous subframe $e^m(l-1)$ is ignored and the energy measure difference $e_d$ is determined by comparing the energy measure $e^m(l)$ of the current subframe to the unit-weighted energy threshold constant value $e_{thresh}$. If $a_e=1$ and $b_e=0$, then the energy measure difference $e_d$ is determined by comparing the energy measure $e^m(l)$ of the current subframe to the energy measure $e^m(l-1)$ of the previous subframe. By selecting values of $a_e$ and $b_e$ between 0 and 1, one may adjust the comparison to include any desired proportion of $e_{thresh}$ and/or any desired proportion of the previous subframe's energy measure.

The foregoing technique examines all subframes to detect the "most significant" plosive within each frame, in case more than one subframe within a particular frame happens to satisfy whatever energy variation criteria is defined for plosive identification purposes. Thus, the plosive locator $l_{pl}$, and the "previous" value $e_d^P$ of the energy measure difference $e_d$ are each initialized at zero. If application of the comparison technique described in the preceding paragraph to a particular frame results in derivation of a value $e_d>0$ for any subframe l within that frame, then the plosive locator $l_{pl}$ is assigned to that subframe (i.e. $l_{pl}=l$ and the value of $e_d$ becomes the new value of $e_d^P$. If subsequent application of the comparison technique to the same frame results in derivation of another value of $e_d$ which exceeds the previously saved value of $e_d^P$, then the plosive locator is updated by assigning it to the subframe having the new, higher, $e_d$ value; and, that new, higher, value of $e_d$ becomes the new value of $e_d^P$. Consequently, after the comparison technique has been applied to all subframes within the particular frame, $e_d^P$ contains the highest (i.e. "most significant") energy measure difference for all subframes within the frame; and, the plosive locator $l_{pl}$ identifies the subframe for which $e_d^P$ has the highest (i.e. "most significant") energy measure difference value.

The technique used to compute the plosive locator, $l_{pl}$, is illustrated in FIGS. 2A–2E. Each of FIGS. 2A–2E depicts an $m^{th}$ frame having four subframes. l=0 denotes the last subframe of the previous (i.e. $m-1^{th}$) frame. l=1, l=2, l=3 and l=4 respectively denote the first, second, third and fourth subframes of the $m^{th}$ frame. $e^m(\mathbf{0})$ denotes the energy measure for the last subframe of the previous (i.e. $m-1^{th}$) frame. $e^m(\mathbf{1})$, $e^m(\mathbf{2})$, $e^m(\mathbf{3})$ and $e^m(\mathbf{4})$ respectively denote the energy measure for subframes l=1, l=2, l=3 and l=4.

Figure 2A:
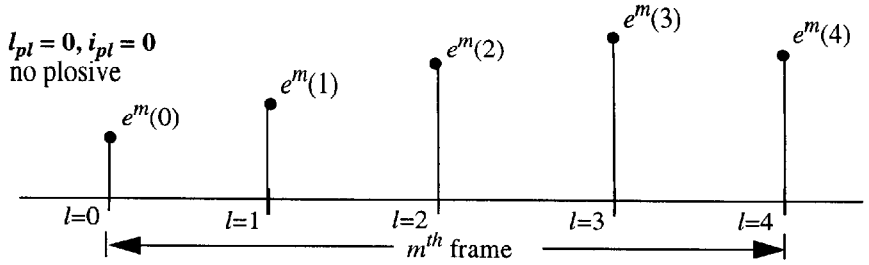
FIGS. 2A–2E respectively depict detection and location of plosives in an $m^{th}$ frame having four subframes, for the case in which no plosive exists (FIG. 2A); and, for cases in which plosives are detected and located at the transitions of: the first and second subframes (FIG. 2B), the second and third subframes (FIG. 2C), the third and fourth subframes (FIG. 2D), and the fourth subframe of the $m^{th}$ frame and the first subframe of the $m+1^{th}$ frame (FIG. 2E).

For purposes of illustration only, FIGS. 2A–2E, assume that the previously described technique is applied by assigning $a_e=1$, $b_e=1$ and $e_{thresh}=10$ dB, meaning that plosive detection involves a comparison of each subframe's energy measure to a energy threshold comprising the previous subframe's energy measure plus a 10 dB energy threshold constant value. FIG. 2A depicts a case in which the energy measure $e^m(l)$ does not exceed the energy threshold for any subframe within the $m^{th}$ frame. Therefore, no plosive exists in the $m^{th}$ frame depicted in FIG. 2A. The plosive locator $l_{pl}$ which is assigned in this case is equal to 0 (i.e. $l_{pl}=0$).

Figure 2B:
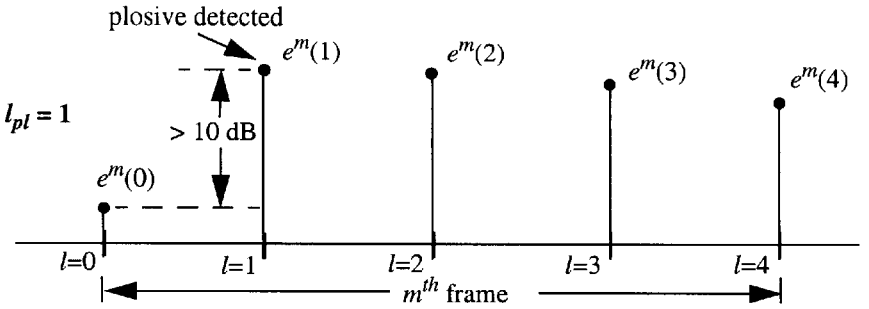

FIG. 2B depicts a case in which the energy measure $e^m(l)$ in subframe l=1 exceeds the energy threshold $e^{th}(l)$ by the largest margin amongst all subframes for which the energy measure exceeds the energy threshold. This means that a plosive has been detected and that the plosive is located at the transition from subframe 1 to subframe 2. The plosive locator $l_{pl}$ which is assigned in this case is $l_{pl}$=1.

Figure 2C:
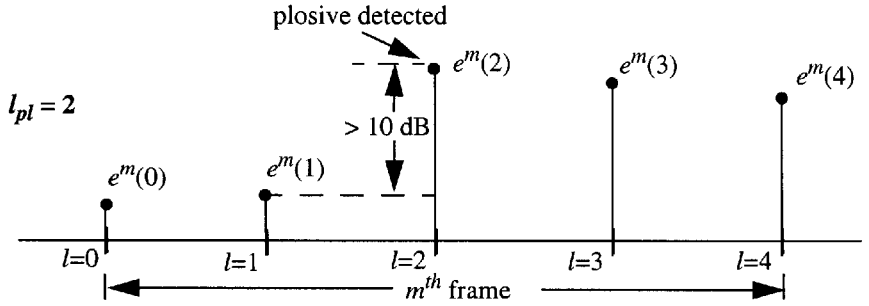

FIG. 2C depicts a case in which the energy measure $e^m(2)$ in subframe l=2 exceeds the energy threshold $e_{th}(2)$ by the largest margin amongst all subframes for which the energy measure exceeds the energy threshold. This means that a plosive has been detected and that the plosive is located at the transition of subframes 2 and 3. The plosive locator $l_{pl}$ which is assigned in this case is $l_{pl}$=2.

Figure 2D:
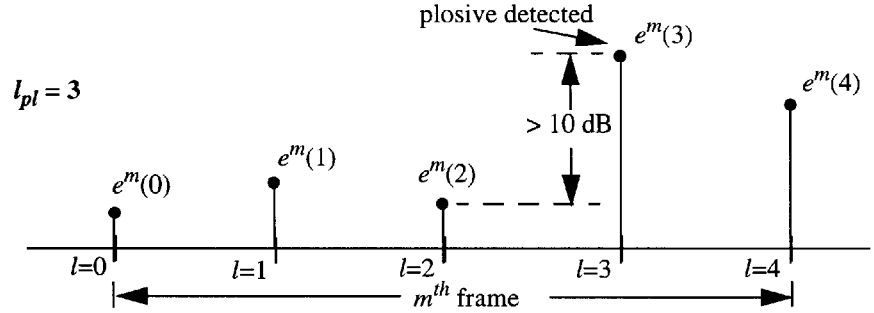

FIG. 2D depicts a case in which the energy measure $e^m(3)$ in subframe l=3 exceeds the energy threshold $e_{th}(3)$ by the largest margin amongst all subframes for which the energy measure exceeds the energy threshold. This means that a plosive has been detected and that the plosive is located at the transition of subframes 3 and 4. The plosive locator $l_{pl}$ which is assigned in this case is $l_{pl}$=3.

Figure 2E:
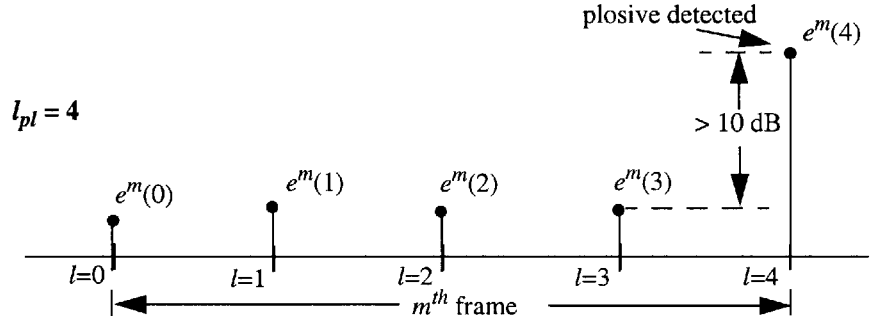

FIG. 2E depicts a case in which the energy measure $e^m(4)$ in subframe l=4 exceeds the energy threshold $e_{th}(4)$ by the largest margin amongst all subframes in which the energy measure exceeds the energy threshold. This means that a plosive has been detected and that the plosive is located at the transition of subframe 4 of the $m^{th}$ frame and the first subframe of the next (i.e. $m+1^{th}$) frame. The plosive locator $l_{pl}$ which is assigned in this case is $l_{pl}$=4.

In general, if the plosive locator, $l_{pl}$=0, then no plosive exists within the $m^{th}$ frame, the plosive index, $i_{pl}$=0, and any gain variations within that frame can be derived by interpolation techniques. However, if the plosive locator, $l_{pl}$, is non-zero, then a plosive exists within the $m^{th}$ frame and the plosive locator, $l_{pl}$, defines the subframe, within the $m^{th}$ frame, at the end of which the start of the burst portion of the plosive is found.

If a plosive is detected within the $m^{th}$ frame, (i.e. $l_{pl}\neq 0$), the plosive index, $i_{pl}$, in the $m^{th}$ frame, is determined as follows (typically, J=2, K=3, $g_{level}=\{100, 45, 0\}$):

if ($l_{pl}$<L)

$i_{pl}=J(l_{pl}-1)+k$ k=j if $g^m(l_{pl})\epsilon(g_{level}(j-1),g_{level}(j)]$, j=1, . . . , J else $i_{pl}=2^K-1$ end if where, J is the number of levels used in quantizing the gain, $g^m(l_{pl})$, $K=\lceil \log_2(J(L-1)+2)\rceil$ is the number of bits used in encoding the plosive locator $l_{pl}$ and $g_{level}=\{g_{level}(j)$: j=0, . . . , J} is the quantized gain decision level vector used in encoding the gain, $g^m(l_{pl})$.

Each of FIGS. 3A–3D depicts an $m^{th}$ frame having four subframes. l=0 denotes the last subframe of the previous (i.e. $m-1^{th}$) frame. l=1, l=2, l=3 and l=4 respectively denote the first, second, third and fourth subframes of the $m^{th}$ frame. $g^m(0)$ denotes the gain for the last subframe of the previous (i.e. $m-1^{th}$) frame. $g^m(1)$, $g^m(2)$, $g^m(3)$ and $g^m(4)$ respectively denote the gain for subframes l=1, l=2, l=3 and l=4.

Figure 3A:
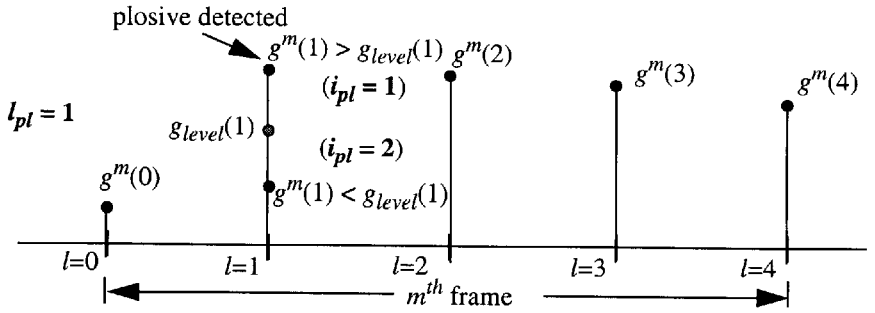
FIGS. 3A–3D depict determination of plosive index for plosive detection and location cases which correspond to FIGS. 2B–2E respectively.

FIGS. 3A–3D depict application of the above plosive index determination procedure for cases corresponding to FIGS. 2B–2E respectively. For example, FIG. 3A depicts the case $l_{pl}$=1 in which a plosive is detected in subframe 1 and is located at the transition from subframe 1 to subframe 2. The plosive index $i_{pl}$ which is assigned in this case is either $i_{pl}$=1 if the gain $g^m(1)$ at the subframe transition (i.e. the transition from l=1 to l=2) exceeds $g_{level}(1)$, as defined above;

or, $i_{pl}=2$ if $g^m(1)<g_{level}(1)$.

Figure 3B:
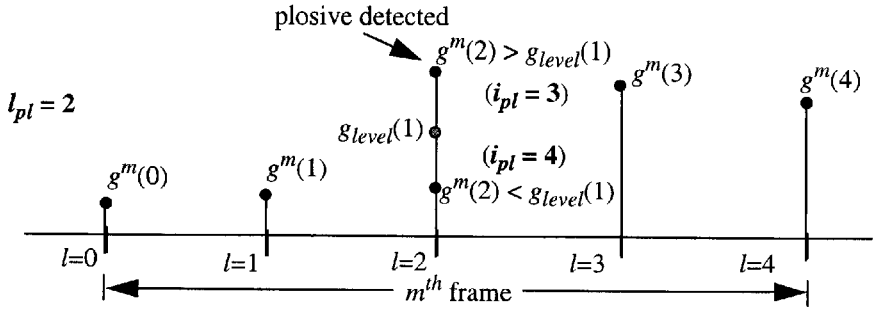

FIG. 3B depicts the case $l_{pl}$=2 in which a plosive is detected in subframe 2 and is located at the transition from subframe 2 to subframe 3. The plosive index $i_{pl}$ which is assigned in this case is either $i_{pl}$=3 if the gain $g^m(2)$ at the subframe transition (i.e. the transition from l=2 to l=3) exceeds $g_{level}(1)$; or, $i_{pl}$=4 if $g^m(2)<g_{level}(1)$.

Figure 3C:
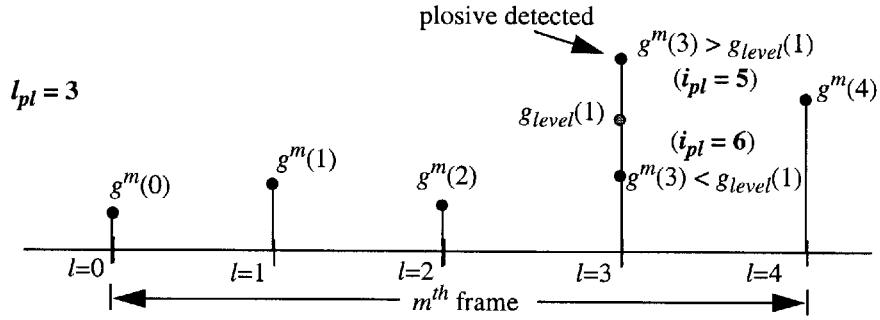

FIG. 3C depicts the case $l_{pl}$=3 in which a plosive is detected in subframe 3 and is located at the transition from subframe 3 to subframe 4. The plosive index $i_{pl}$ which is assigned in this case is either $i_{pl}$=5 if the gain $g^m(3)$ at the subframe transition (i.e. the transition from l=3 to l=4) exceeds $g_{level}(1)$; or, $i_{pl}$=6 if $g^m(3)<g_{level}(1)$.

Figure 3D:
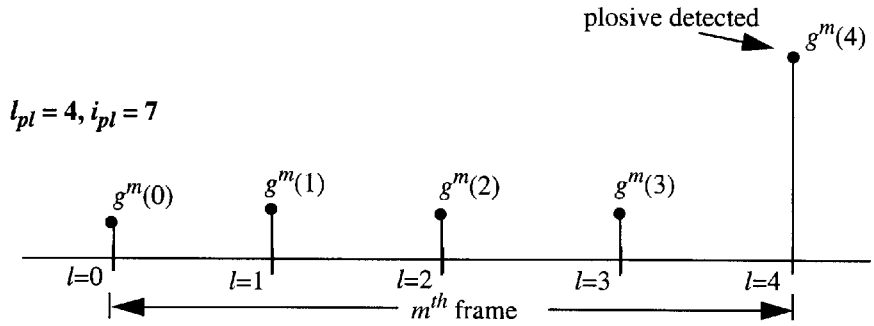

FIG. 3D depicts the case $l_{pl}$=4 in which a plosive is detected in subframe 4 and is located at the transition from subframe 4 of the $m^{th}$ frame and the first subframe of the next (i.e. $m+1^{th}$) frame. The plosive index $i_{pl}$ which is assigned in this case is equal to 7 (i.e. $i_{pl}$=7).

In general, if the plosive index, $i_{pl}$=0, then no plosive exists within the $m^{th}$ frame, and any gain variations within that frame can be derived by interpolation techniques. However, if the index, $i_{pl}$, is non-zero, then a plosive exists within the $m^{th}$ frame.

3. Decoding Plosive Locator from Plosive Index

If a plosive is detected within the $m^{th}$ frame, (i.e. $i_{pl}\neq 0$), then the plosive locator, $l_{pl}$, is obtained (FIG. 1, block 24) as follows:

if($i_{pl}<2^K-1$ $$l_{pl}=\left\lceil \frac{i_{pl}}{J}\right\rceil$$

else $l_{pl}$=L end if

The plosive index, $i_{pl}$, and the plosive locator, $l_{pl}$, are used to determine the gain variation of the excitation signal from one subframe to the next within the $m^{th}$ frame, as will now be described.

4. Computation of Quantized Frame Gain

If a plosive is detected within the $m^{th}$ frame, (i.e. $i_{pl}\neq 0$), then a quantized frame gain vector (in dBs), $g_q^m$ is computed by the decoder (FIG. 1, block 26). More particularly, because the gain vector, $g^m$, is not directly available to the decoder, the gain vector $g^m$ is encoded as $g_q^m$ by the encoder for use by the decoder. In low bit-rate encoding of speech, bits available for encoding the various parameters are at a premium, hence any savings that can be obtained by reducing the number of parameters encoded yield large savings in the encoded bit-rate. One such approach, for frames which contain a plosive, is to quantize any one subframe gain ($g^m(L)$ for example) within the frame, using few bits for encoding, and then estimating the remaining elements of the quantized gain vector without using any additional bits to encode the remaining subframe gains, thus reducing the number of parameters encoded and consequently reducing the encoded bit-rate. The purpose of estimating the remaining elements of the gain vector is to ensure sudden energy variation during plosives.

In the preferred embodiment of the invention $g_q^m$ is determined as follows, although alternative techniques can be used to ensure sudden energy variation during plosives (typically, $g_{thresh}=10$, $g_{v_offset}=3$, $g_{u_offset}=10$, $g_{sil}=10$, $g_{rec}=\{53, 42\}$):

obtain $g_q^m(L)$ by techniques well known in the art (FIG. 1, block 18)

define $g_q^m(\mathbf{0})=g_q^{m-1}(L)$ if $l_{pl}<L$ $g_q^m(l_{pl})=g_{rec}(j) j=i_{pl} \bmod J$ end if if $l_{pl}>1$ $g_q^m(l_{pl}-1)=0.5\ g_q^m(\mathbf{0})+0.5\ g_{sil}$ $g_q^m(l_{pl}-1)=\min(g_q^m(l_{pl}-1), g_q^m(l_{pl})-g_{thresh})$ compute $g_q^m(l)$ by linearly interpolating between $g_q^m(\mathbf{0})$ and $g_q^m(l_{pl}-1)$ for subframes $l=1, \ldots, l_{pl}-2$.

end if if $l_{pl}<L-1$ if $c(L)=1$ $$g_q^m(l)=\begin{cases} g_q^m(L)-g_{v_offset} & \text{if } c(l)=1,\ l=l_{pl}+1, \ldots, L-1 \\ g_q^m(L)-g_{u_offset} & \text{otherwise},\ l=l_{pl}+1, \ldots, L-1 \end{cases}$$

else $g_q^m(l)=g_q^m(L)\ l=l_{pl}+1, \ldots, L-1$ end if where, $g_{v_offset}$ and $g_{u_offset}$ are gain offset values, $g_{sil}$ is the silence gain value, $g_{rec}=\{g_{rec}(j): j=1, \ldots, J\}$ is the quantized gain reconstruction vector used in encoding the gain, $g^m(l_{pl})$ and $g_{thresh}$ is the threshold gain value. The "mod" operation returns the remainder after dividing the first operand by the second operand.

The quantized frame gain vector (in dBs), $g_q^m$, can be represented by its linear equivalent, $\hat{g}_q^m$, as, $\hat{g}_q^m(l)=10^{(g_{mq}(l)/20)}$ $l=1, \ldots, L$ 5. Computation of Unvoiced Plosive Synthetic Gain In the preferred embodiment of the invention the gain variation, $g_i$, from one sample to another within a frame containing an unvoiced plosive ($i_{pl}\neq 0$), is determined (FIG. 1, block 28) as follows, although alternative techniques can be used to ensure sudden energy variation during plosives:

for $l=l_{start}$ to $l_{stop}$ if $(l<l_{pl})$ $g_i(n)=a_g(n)\hat{g}_q^m(l-1)+b_g(n)\hat{g}_q^m(l-2)\ n=1, \ldots, N/L$ else if $(l=l_{pl})$ $g_i(n)=\hat{g}_q^m(l-1)\ n=1, \ldots, N/L$ else Compute $g_i$ for all samples in subframe by linearly interpolating between $\hat{g}_q^m(l-1)$ and $\hat{g}_q^m(l)$.

end if end where, $a_g$ and $b_g$ are gain interpolation weight vectors used in computing the gain trajectory within subframes prior to subframe $l_{pl}$. Typically, $a_g(n)=1$ and $b_g(n)=0$ for all values of n.

Figure 4A:
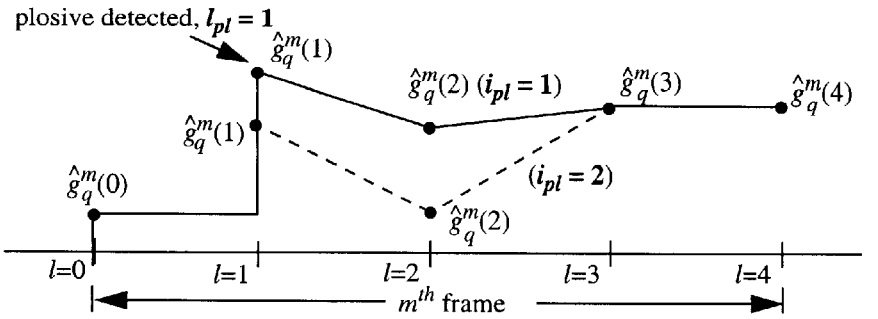
FIGS. 4A–4D depict determination of unvoiced synthetic gain variation for plosive detection and location cases which correspond to FIGS. 2B–2E respectively.

The above synthetic gain variation determination procedure is applied only if a plosive exists within a particular frame. FIGS. 4A–4D depict application of the above synthetic gain variation determination procedure for cases corresponding to FIGS. 2B–2E respectively. For example, FIG. 4A depicts the case $l_{pl}=1$ in which a plosive is detected in subframe 1 and is located at the transition from subframe 1 to subframe 2 (i.e. $i_{pl}=1$ or $i_{pl}=2$, as explained above). The synthetic gain $g_i$ remains constant throughout the first subframe, then increases suddenly (i.e. from $\hat{g}_q^m(\mathbf{0})$ to $\hat{g}_q^m(\mathbf{1})$ at the transition from subframe 1 to subframe 2 to represent the plosive. The gain in the subsequent subframes is then obtained by linear interpolation. In particular, the solid line in FIG. 4A depicts interpolation of the gains for the case in which $i_{pl}=1$ as described above; and, the dashed line in FIG. 4A depicts interpolation of the gain for the case in which $i_{pl}=2$.

Figure 4B:
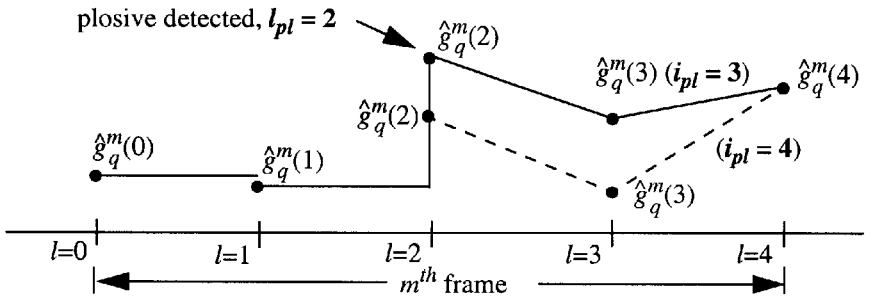

FIG. 4B depicts the case $l_{pl}=2$ in which a plosive is detected in subframe 2 and is located at the transition from subframe 2 to subframe 3 (i.e. $i_{pl}=3$ or $i_{pl}=4$, as explained above). The synthetic gain $g_i$ remains piecewise constant through the first and second subframes, then increases suddenly (i.e. from $\hat{g}_q^m(\mathbf{1})$ to $\hat{g}_q^m(\mathbf{2})$ at the transition from subframe 2 to subframe 3 to represent the plosive. The gain in the subsequent subframes is then obtained by linear interpolation. In particular, the solid line in FIG. 4B depicts interpolation of the gains for the case in which $i_{pl}=3$; and, the dashed line in FIG. 4B depicts interpolation of the gains for the case in which $i_{pl}=4$.

Figure 4C:
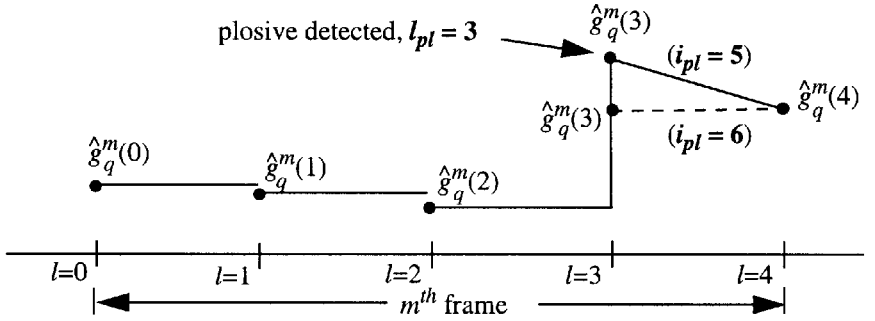

FIG. 4C depicts the case $l_{pl}=3$ in which a plosive is detected in subframe 3 and is located at the transition from subframe 3 to subframe 4 (i.e. $i_{pl}=5$ or $i_{pl}=6$, as explained above). The synthetic gain $g_i$ remains piecewise constant through the first, second and third subframes, then increases suddenly (i.e. from $\hat{g}_q^m(\mathbf{2})$ to $\hat{g}_q^m(\mathbf{3})$) at the transition from subframe 3 to subframe 4 to represent the plosive. The gain in the fourth subframe is then obtained by linear interpolation. In particular, the solid line in FIG. 4C depicts interpolation of the gains for the case in which $i_{pl}=5$; and, the dashed line in FIG. 4B depicts interpolation of the gains for the case in which $i_{pl}=6$.

Figure 4D:
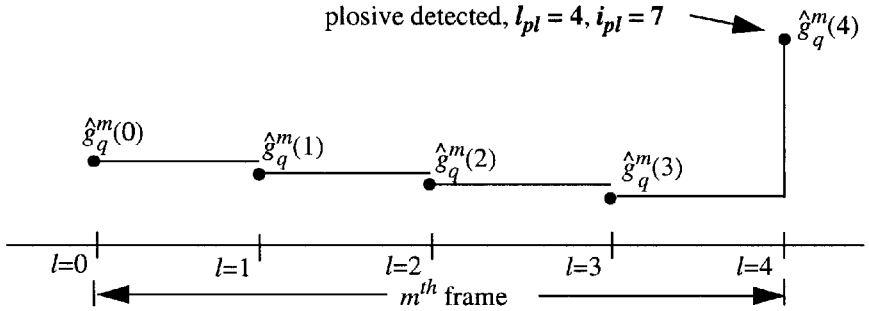

FIG. 4D depicts the case $l_{pl}=4$ in which a plosive is detected in subframe 4 and is located at the transition from subframe 4 of the $m^{th}$ frame and the first subframe of the next (i.e. $m+1^{th}$) frame (i.e. $i_{pl}=7$, as explained above). The synthetic gain $g_i$ remains piece-wise constant through the first, second, third and fourth subframes, then increases suddenly (i.e. from $\hat{g}_q^m(\mathbf{3})$ to $\hat{g}_q^m(\mathbf{4})$) at the transition from subframe 4 to the first subframe of the next (i.e. $m+1^{th}$) frame to represent the plosive.

As will be apparent to those skilled in the art in the light of the foregoing disclosure, many alterations and modifications are possible in the practice of this invention without departing from the spirit or scope thereof. For example, as noted above, the energy measure used to detect and locate unvoiced plosives may be obtained in any one of a number of ways which are well known to persons skilled in the art. The same is true in selecting the threshold values used to identify the sudden energy changes characteristic of unvoiced plosives.

As a further example, the location of the start of the burst portion of the plosive may be encoded in different ways. Thus, instead of assigning $i_{pl}$ as having L+1 possible values, one could represent $i_{pl}$ as having at least J(L−1)+2 different values and implicitly encoding (within the plosive index $i_{pl}$) the gain, $g^m(l_{pl})$, to have one of J possible values. Appropriate values of $g_{level}$ and $g_{rec}$ can be selected to provide further variation in the algorithm.

Alternative techniques can be used to quantize the frame gain vector. For example, instead of quantizing $g^m(l_{pl})$ to $g_q^m(l_{pl})$ as described above, one could alternatively obtain a more accurate quantized gain value at the expense of an increase in encoded bit-rate, by actually encoding independently the gain $g^m(l_{pl})$ with a few extra bits using techniques well known in the art. Similar procedures could be carried out individually or collectively for the other subframe gains.

The gain variation from one sample to another within a frame containing an unvoiced plosive may be determined in a manner different than that outlined above, while preserving the ability to synthesize the sudden energy variations which characterize plosives. Thus, instead of holding the synthetic gain $g_i$ piecewise constant during the subframes prior to the subframe $l_{pl}$, one could interpolate the prior subframe gains to obtain the synthetic gain. This can be achieved by modifying the gain interpolation weight vectors $a_g$ and $b_g$.

What is claimed is:

1. A method of encoding signal segments representative of unvoiced plosives in a speech signal divided into m=1, . . . , N frames, each of said frames subdivided into l=1, . . . , L subframes, said speech signal having a gain $g^m(l)$ within each of said subframes, said method comprising the steps of:

(a) defining an energy measure $e^m(l)$ representative of energy content of said signal segments;

(b) defining an energy threshold $e_{th}(l)$ representative of a sudden energy change characteristic of an unvoiced plosive;

(c) for each one of said frames:

(i) deriving said energy measure $e^m(l)$ for each one of said subframes within said one frame;

(ii) deriving said energy threshold $e_{th}(l)$ for each one of said subframes within said one frame;

(iii) if $e^m(l) \leqq e_{th}(l)$ for each one of said subframes within said one frame, assigning a plosive locator $l_{pl}=0$ and a plosive index $i_{pl}=0$ to said one frame to indicate absence of a plosive within said one frame;

(iv) if $e^m(l)>e_{th}(l)$ for any one of said subframes within said one frame:

(1) assigning said plosive locator $l_{pl}$ a non-zero value for said one frame, said non-zero $l_{pl}$ value indicating location of a plosive at a transition point immediately following that one of said subframes within said one frame for which $e^m(l)-e_{th}(l)$ is greatest; and, (2) assigning said plosive index $i_{pl}$ a non-zero value for said one frame, said non-zero $i_{pl}$ value indicating presence of a plosive within said one frame.

2. A method as defined in claim 1, wherein said energy threshold $e_{th}(l)$ has a selected value $e_{th}(l)=a_e e^m(l-1)+b_e e_{thresh}$ for each one of said subframes, where $a_e$ and $b_e$ are predefined weighting constants and $e_{thresh}$ is a threshold energy constant value.

3. A method as defined in claim 1, wherein said non-zero $i_{pl}$ value is assigned as:

(a) $i_{pl}=J(l_{pl}-1)+k$ if said plosive locator $l_{pl}$ is less than L, wherein k has a value j which satisfies the relationship $$g^m(l_{pl}) \in (g_{level}(j-1),\ g_{level}(j)),\ \text{for } j=1, \ldots J;\ \text{and,}$$

(b) $i_{pl}=2^K-1$ if said plosive locator $l_{pl}$ is equal to L;

wherein $l_{pl}$ is said subframe within said one frame for which $e^m(l)-e_{th}(l)$ is greatest, $g^m(l_{pl})$ is the gain within said subframe $l_{pl}$, J is the number of levels used to encode said gain, K is the number of bits used to encode $l_{pl}$, and $g_{level}=\{g_{level}(j): j=0, \ldots, J\}$ is a predefined quantized gain decision level vector used to encode said gain.

4. A method as defined in claim 3, wherein $K=\lceil \log_2(J(L-1)+2)\rceil$.

5. A method as defined in claim 1, wherein said energy measure $e^m(l)$ is said gain $g^m(l)$ of said respective signal segments.

6. A method of decoding a signal encoded in accordance with claim 1, said encoded signal divided into m=1, . . . , N frames, each of said frames subdivided into l=1, . . . , L subframes, said signal having a gain value $g^m(l)$ in each of said subframes, said decoding method comprising mapping said gain value $g^m(l)$ to a quantized gain value $g_q^m(l)$ by:

(a) deriving a quantized gain value $g_q^m(L)$ for said $L^{th}$ subframe;

(b) setting $g_q^m(\mathbf{0})=g_q^m(L)$;

(c) if $l_{pl}<L$, setting $g_q^m(l_{pl})=g_{rec}(j)$, where $j=i_{pl} \bmod J$ and $g_{rec}$ is a predefined quantized gain reconstruction vector;

(d) if $l_{pl}>1$, deriving a quantized gain value $g_q^m(l_{pl}-1)$;

(e) if $l_{pl}>1$, deriving said quantized gain value $g_q^m(l)$ by linearly interpolating between $g_q^m(\mathbf{0})$ and $g_q^m(l_{pl}-1)$ for all values of $l=1, \ldots, l_{pl}-2$; and, (f) if $l_{pl}<L-1$, deriving said quantized gain value $g_q^m(l)$ for all values of $l=l_{pl}+1, \ldots, L-1$.

7. A method as defined in claim 6, further comprising decoding said plosive locator $l_{pl}$ as $$l_{pl}=\left\lceil \frac{i_{pl}}{J} \right\rceil$$

if $i_{pl}<2^K-1$; and, as $l_{pl}=L$ if $i_{pl}=2^K-1$.

8. A method as defined in claim 6, wherein said quantized gain $g_q^m(l_{pl}-1)$, has a selected value $$g_q^m(l_{pl}-1)=\min(0.5\ g_q^m(\mathbf{0})+0.5\ g_{sil},\ g_q^m(l_{pl})-g_{thresh}),\ \text{if } l_{pl}>1,\ \text{where } g_{sil}$$

is a predefined silence gain value and $g_{thresh}$ is a predefined gain threshold value.

9. A method as defined in claim 6, wherein, for all values of $l=l_{pl}+1, \ldots, L-1$, and $l_{pl}<L-1$ said quantized gain value $g_q^m(l)$ has a selected value:

(a) $g_q^m(l)=g_q^m(L)$ if c(L)=0;

(b) $g_q^m(l)=g_q^m(L)-g_{v_offset}$ if c(l)=1 and c(L)=1; and, (c) $g_q^m(l)=g_q^m(L)-g_{u_offset}$ if c(l)=0 and c(L)=1;

wherein $g_{v_offset}$ and $g_{u_offset}$ are predefined gain offset values, c(L) is a predefined class information value for said $L^{th}$ subframe, c(l) is a predefined class information value for said $l^{th}$ subframe, c(l)=0 denotes that said subframe l is unvoiced, and c(l)=1 denotes that said subframe l is voiced.

10. A method as defined in claim 9, further comprising setting $$g_q^m(l_{pl}+1) \text{ to } g_q^m(l_{pl}+1)=\min(g_q^m(l_{pl}+1),\ g_q^m(l_{pl})-g_{thresh}) \text{ when } l_{pl}<L-1.$$

11. A method as defined in claim 6, further comprising deriving a synthetic gain variation g, for each one of said frames for which said plosive index $i_{pl}\neq 0$, by:

(a) if $l<l_{pl}$ deriving $g_i(n)\ a_g(n)\hat{g}_q^m(l-1)+b_g(n)\hat{g}_q^m(l-2)$, n=1, . . . , N/L;

(b) if $l=l_{pl}$ deriving $g_i(n)=\hat{g}_q^m(l-1)$, n=1, . . . , N/L; and, (c) if $l>l_{pl}$ deriving said synthetic gain variation $g_i$ by linearly interpolating between $\hat{g}_q^m(l-1)$ and $\hat{g}_q^m(l)$;

wherein $a_g$ and $b_g$ are predefined gain interpolation weight vectors.

* * * * *